US008695895B2

(12) United States Patent
Shi

(10) Patent No.: US 8,695,895 B2
(45) Date of Patent: Apr. 15, 2014

(54) TWO-WAY NOZZLE CAP

(75) Inventor: Feng Shi, Shanghai (CN)

(73) Assignee: S.C. Johnson & Son, Inc., Racine, WI (US)

( * ) Notice: Subject to any disclaimer, the term of this patent is extended or adjusted under 35 U.S.C. 154(b) by 977 days.

(21) Appl. No.: 12/450,849

(22) PCT Filed: Apr. 17, 2008

(86) PCT No.: PCT/US2008/004953

§ 371 (c)(1),
(2), (4) Date: Dec. 3, 2009

(87) PCT Pub. No.: WO2008/133828

PCT Pub. Date: Nov. 6, 2008

(65) Prior Publication Data

US 2010/0090028 A1 Apr. 15, 2010

(30) Foreign Application Priority Data

Apr. 23, 2007 (CN) ..... 2007 2 0142828 U

(51) Int. Cl.
*B65D 1/32* (2006.01)

(52) U.S. Cl.
USPC ..... 239/327; 239/491; 239/600; 222/189.1; 222/211; 222/212

(58) Field of Classification Search
CPC .... B05B 11/043; B05B 11/047; B05B 15/005
USPC ..... 239/327, 491, 600; 222/111, 189.1, 95, 222/212, 215
See application file for complete search history.

(56) References Cited

U.S. PATENT DOCUMENTS

| | | | | |
|---|---|---|---|---|
| 3,176,883 | A | 4/1965 | George | |
| 3,519,208 | A * | 7/1970 | Marchant | 239/327 |
| 3,679,137 | A | 7/1972 | Marchant | |
| 4,014,468 | A * | 3/1977 | Silverman et al. | 239/327 |
| 4,093,124 | A * | 6/1978 | Morane et al. | 239/327 |
| 4,378,088 | A * | 3/1983 | Ewing | 239/8 |
| 6,402,054 | B1 * | 6/2002 | Prueter et al. | 239/327 |

OTHER PUBLICATIONS

International Search Report for related international application No. PCT/US2008/004953, report dated Jun. 23, 2008.

* cited by examiner

*Primary Examiner* — Dinh Q Nguyen

(57) ABSTRACT

The present utility model provides a two-way nozzle cap (10) for a container, comprising of a cap body (11) and a dip tube (12), wherein the cap body (11) includes: an engagement portion (21) engaged with the opening of the container; a hollow orifice portion (22) provided in the top of the cap body (11), comprising an orifice formed on the upper part of the orifice portion, at least two protrusions (32) provided on the inner wall of the orifice portion to clamp the upper end of the dip tube, a mixing chamber (33) formed between the orifice and the top of the dip tube (12), and channels defined between the protrusions (32) and the dip tube (12), and fluid communicating the mixing chamber (33) to the interior of the container.

12 Claims, 4 Drawing Sheets

TWO-WAY NOZZLE CAP

Technical Field

The present utility model generally relates to a two-way nozzle cap, and in particular to a two-way nozzle cap for a container having functions of pouring and spraying fluid.

TECHNICAL BACKGROUND

Nowadays, there are various nozzle caps for spraying or pouring liquid. However, these nozzle caps always have only one function, and are not very convenient for users.

For example, U.S. Pat. No. 4,093,124 discloses an atomizer with air inlet valve, comprising a tip with two side ducts connecting the atomization chamber to the interior of the container so that the liquid product can be sprayed in atomized form both in an upright and an inverted position of the container. However, it does not have a dual function and structure of spraying and pouring, but spraying only.

Additionally, there are other nozzle caps, for example, there is one with a central orifice and a plurality of smaller orifices around the central orifice, to spray out liquid at any direction. However, this kind of nozzle caps may only spout out liquid in the form of water stream without atomization effect.

While in use, not only the function of pouring out liquid from a container is needed for a nozzle cap, but also the function of spraying out liquid from a container after atomized is need.

Content of the Utility Model

To resolve the above mentioned problems, the present utility model provides a two-way nozzle cap for a container, comprising of a cap body and a dip tube, wherein the cap body includes: an engagement portion engaged with the opening of the container; a hollow orifice portion provided in the top of the cap body, comprising an orifice formed on the upper part of the orifice portion, at least two protrusions provided on the inner wall of the orifice portion to clamp the upper end of the dip tube, a mixing chamber formed between the orifice and the top of the dip tube, and channels defined between the protrusions and the dip tube, and fluid communicating the mixing chamber to the interior of the container.

The two-way nozzle cap of the present utility model may spray liquid after atomization, or pour the liquid directly according to the requirement, to fulfill the different purposes of the user under different conditions. Moreover, the two-way nozzle cap further has the merits of simple structure, easy to manufacture, low cost, and wide scope of utilization.

DETAILED DESCRIPTION OF THE UTILITY MODEL

The embodiment and operation of the utility model will be described in detail in reference with the drawings.

Figure 1:
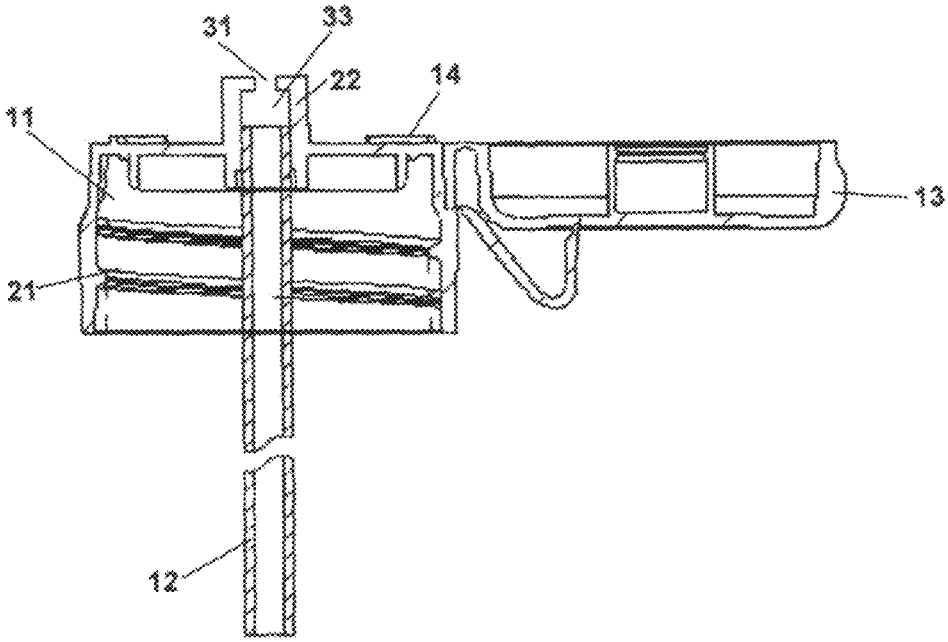
FIG. 1 is a longitudinal cross-sectional view of a two-way nozzle cap in accordance with the first embodiment of the present utility model.
Figure 2:
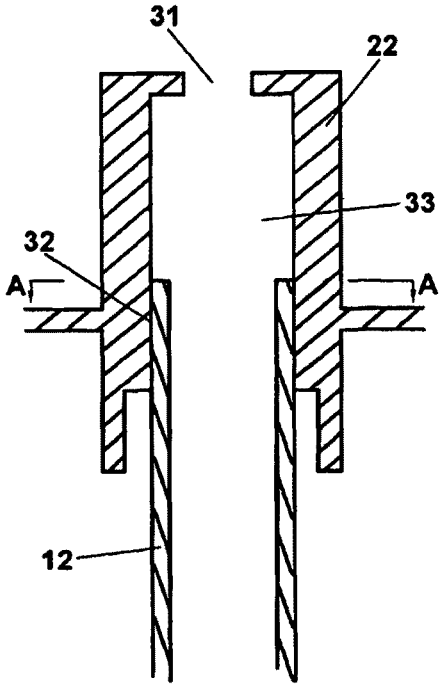
FIG. 2 is an enlarged longitudinally cross-sectional view of an orifice portion of the two-way nozzle cap in accordance with the first embodiment of the present utility model.
Figure 3:
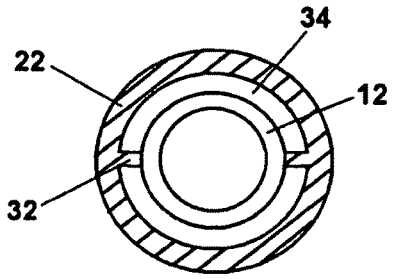
FIG. 3 is a cross-sectional view along the line A-A of FIG. 2.

FIG. 1 is a longitudinal cross-sectional view of a two-way nozzle cap in accordance with the first embodiment of the present utility model. FIG. 2 is an enlarged longitudinally cross-sectional view of an orifice portion of the two-way nozzle cap in accordance with the first embodiment of the present utility model. FIG. 3 is a cross-sectional view along the line A-A of FIG. 2. Referring to FIG. 1, in the first embodiment of the present utility model, a two-way nozzle cap 10 for a container, comprising of a cap body 11 and a dip tube 12. Refer to FIGS. 2 and 3, the cap body 11 includes: an engagement portion 21 engaged with the opening of the container; a hollow orifice portion 22 provided in the top of the cap body, wherein the orifice portion 22 comprises an orifice 31 formed on the upper part of the orifice portion 22, at least two protrusions 32 provided on the inner wall of the orifice portion 22 to clamp the upper end of the dip tube 12, a mixing chamber 33 formed between the orifice 31 and the top of the dip tube 12, and channels 34 defined between the protrusions 32 and the dip tube, and fluid communicating the mixing chamber 33 to the interior of the container. In addition, the engagement portion 21 may be connected to the opening of the container by screwing or by clutching. Additionally, a cap cover 13 may be provided to movably connect to the cap body 11, wherein two or more stages 14 may be formed upwardly from the top surface of the cap body 11, to engage with and close the cap cover 13 while the container is not in use, and to prevent the liquid leaking from the container. According to the two-way nozzle cap of the present utility model, the two protrusions 32 formed in the orifice portion 22 is capable of holding the dip tube 12. Furthermore, channels 34 with sufficient spaces are formed in between the protrusions 32 and the dip tube 12 to allow the liquid to flow through freely.

Figure 4:
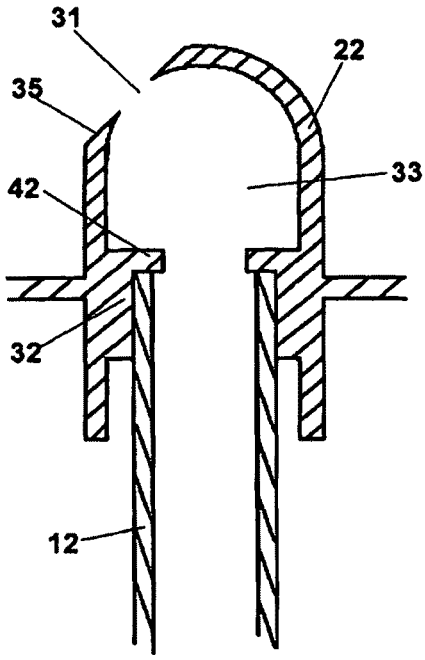
FIG. 4 is an enlarged longitudinally cross-sectional view of an orifice portion of a two-way nozzle cap in accordance with the second embodiment of the present utility model.

FIG. 4 is an enlarged longitudinally cross-sectional view of an orifice portion of a two-way nozzle cap in accordance with the second embodiment of the present utility model. Referring to FIG. 4, the top surface of the orifice portion 22 may be formed as an inclined surface 35 longitudinal tilting relative to the dip tube 12. The orifice 31 is formed in the inclined surface 35 to facilitate the controlling of the spray direction while using the nozzle cap 10. The shape of the orifice 31 shape of the orifice may be round, ellipse, square, rectangle, triangle, or rhombus according to the requirement. Moreover, a tip 42 is formed radially inward from the top of each protrusion to restrain the longitudinal position of the dip tube 12, thus prevent the atomization effect being affect in that the space of the mixing chamber 33 being reduced because of the dip tube 12 inserted too much into the orifice portion 22, and prevent the unstable holding of the dip tube 12 in that it is inserted not enough into the orifice portion 22. The shape and size of the tips 42 may be varied according to needs. However, the normal use of the nozzle cap 10 would not be affected without the tips 42. Further, the sizes of the protrusions 32 may be varied according to need, for example, the longitudinal length may extends until being on the same surface with the lower surface of the orifice portion 22. Moreover, the shape of the protrusions 32 may be hemispherical, cubic, cuboid, ellipsoidal and so on, and preferably be provided longitudinal along the inner wall of the orifice portion 22.

Figure 5:
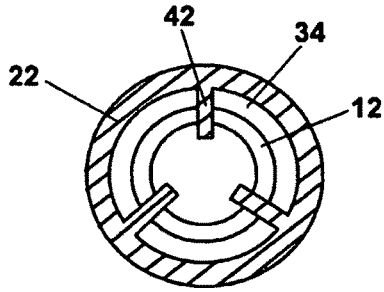
FIG. 5 is an enlarged transversely cross-sectional view of an orifice portion of a two-way nozzle cap in accordance with the third embodiment of the present utility model.
Figure 6:
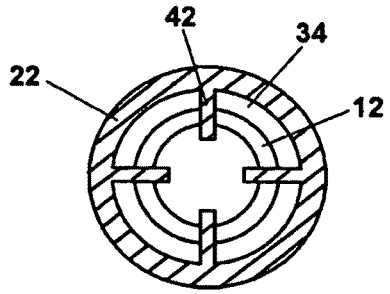
FIG. 6 is a enlarged transversely cross-sectional view of a orifice portion of a two-way nozzle cap in accordance with the forth embodiment of the present utility model.

FIG. 5 is an enlarged transversely cross-sectional view of an orifice portion of a two-way nozzle cap in accordance with the third embodiment of the present utility model. FIG. 6 is a enlarged transversely cross-sectional view of an orifice portion of a two-way nozzle cap in accordance with the forth embodiment of the present utility model. According to FIGS. 5 and 6, three, four or more protrusions 32 may be provided within the orifice portion 22 except two protrusions mentioned in the first and the second embodiments, wherein three protrusions 32 are preferably to stably hold the dip tube 12 and also leave enough space of the channels 34.

Figure 7:
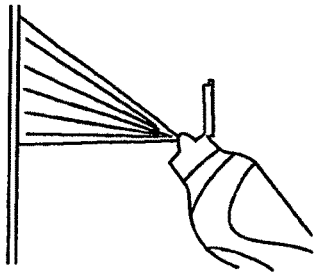
FIG. 7 is a diagrammatic view illustrating the nozzle cap of the present utility model being used to spraying liquid.

FIG. 7 is a diagrammatic view illustrating the nozzle cap of the present utility model being used to spraying liquid. Referring to FIG. 7, in the practical operation, while the container is squeezed with the orifice 31 being positioned vertical upward or inclining upward, liquid rises from the interior of the container along the dip tube 12 into the mixing chamber 33 in the orifice portion 22, at the same time, air enters the mixing chamber 33 along the channels 34 from the space above the liquid in the container. Under the pressure, the liquid and the air in the mixing chamber 33 are well mixed and atomized, and then are sprayed through the orifice 31.

Figure 8:
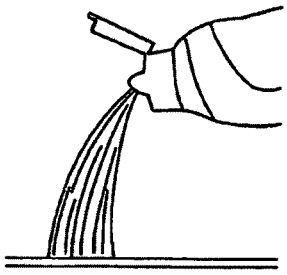
FIG. 8 is a diagrammatic view illustrating the nozzle cap of the present utility model being used to pouring liquid.

FIG. 8 is a diagrammatic view illustrating the nozzle cap of the present utility model being used to pouring liquid. Referring to FIG. 8, in the practical operation, while the container is squeezed with the orifice 31 being positioned vertical downward or inclining downward, liquid is accumulated at the top portion of the container, thus there is no liquid entering the dip tube 12 opening at the bottom of the container. The fluid channels 34 are roomy enough to let the fluid flowing through and entering the mixing chamber 33, and there is only little air entering the dip tube 12, therefore, the liquid in the mixing chamber 33 can not be atomized cause lacking of sufficient air. Thus, the liquid flows through the orifice 31 as fluid stream or fluid column.

According to the above description, the two-way nozzle cap of the present utility model may spray liquid after atomization, or pour the liquid directly according to the requirement, to fulfill the different purposes of the user under different conditions. Moreover, the two-way nozzle cap further has the merits of simple structure, easy to manufacture, low cost, and wide scope of utilization.

Based on the above description, although the embodiments of the present utility model have been described and illustrated, the utility model is not intended to be limited by the embodiments. Those skills in the art can make various change and amendment to the present utility model without departing from the spirit and scope defined by the appended claims.

The invention claimed is:

1. A two-way nozzle cap for a container, comprising a cap body and a dip tube, wherein the cap body includes:

an engagement portion engaged with the opening of the container, a hollow orifice portion provided in the top of the cap body, comprising an orifice formed on the upper part of the orifice portion, at least two protrusions provided on the inner wall of the orifice portion to clamp the upper end of the dip tube, at least one of the protrusions having a tip extending radially inward from the top thereof and into the hollow orifice portion, a mixing chamber formed between the orifice and the top of the dip tube to mix air and liquid for atomization, and channels defined between the protrusions and the dip tube, and fluid communicating the mixing chamber to the interior of the container.

2. The two-way nozzle cap for a container according to claim 1, wherein the protrusions are longitudinally provided on the inner wall of the orifice portion.

3. The two-way nozzle cap for a container according to claim 1, wherein there are three said protrusions within the orifice portion.

4. The two-way nozzle cap for a container according to claim 1, wherein there are four said protrusions within the orifice portion.

5. The two-way nozzle cap for a container according to claim 1, wherein the protrusions each has a tip extending radially inward from the top thereof.

6. The two-way nozzle cap for a container according to claim 1 wherein the dip tube terminates at tips of the protrusions.

7. The two-way nozzle cap for a container according to claim 1, wherein the orifice portion has an inclined surface at the top portion of the orifice portion.

8. The two-way nozzle cap for a container according to claim 7, wherein the orifice is formed in the inclined surface of the orifice portion.

9. The two-way nozzle cap for a container according to claim 1, wherein the shape of the orifice may be round, ellipse, square, rectangle, triangle, or rhombus.

10. The two-way nozzle cap for a container according to claim 1, wherein the engagement portion may be screwed on the opening of the container.

11. The two-way nozzle cap for a container according to claim 1, wherein a cap cover is movably connected to the cap body.

12. The two-way nozzle cap for a container according to claim 1, wherein two stages are formed upwardly from the top surface of the cap, to engage with and close the cap cover.

* * * * *